US009752248B2

(12) United States Patent
Kagajwala et al.

(10) Patent No.: US 9,752,248 B2
(45) Date of Patent: Sep. 5, 2017

(54) METHODS AND APPARATUSES FOR DYNAMICALLY TUNABLE WAFER-EDGE ELECTROPLATING

(71) Applicant: Lam Research Corporation, Fremont, CA (US)

(72) Inventors: Burhanuddin Kagajwala, Hillsboro, OR (US); Bryan L. Buckalew, Tualatin, OR (US); Aaron Berke, Portland, OR (US); James Isaac Fortner, Newberg, OR (US); Robert Rash, West Linn, OR (US)

(73) Assignee: Lam Research Corporation, Fremont, CA (US)

( * ) Notice: Subject to any disclaimer, the term of this patent is extended or adjusted under 35 U.S.C. 154(b) by 111 days.

(21) Appl. No.: 14/578,068

(22) Filed: Dec. 19, 2014

(65) Prior Publication Data

US 2016/0177466 A1 Jun. 23, 2016

(51) Int. Cl.

| | |
|---|---|
| ***C25D 17/00*** | (2006.01) |
| ***C25D 17/02*** | (2006.01) |
| ***C25D 5/02*** | (2006.01) |

(52) U.S. Cl.

CPC ..... *C25D 17/001* (2013.01); *C25D 5/022* (2013.01); *C25D 17/002* (2013.01)

(58) Field of Classification Search

CPC ..... C25D 17/001; C25D 17/002; C25D 5/022
See application file for complete search history.

(56) References Cited

U.S. PATENT DOCUMENTS

| | | | |
|---|---|---|---|
| 3,880,725 | A | 4/1975 | Van Raalte et al. |
| 4,304,641 | A | 12/1981 | Grandia et al. |

(Continued)

FOREIGN PATENT DOCUMENTS

| | | |
|---|---|---|
| CA | 1 236 627 | 7/1986 |
| CN | 1531028 A | 9/2004 |

(Continued)

OTHER PUBLICATIONS

U.S. Appl. No. 14/602,910, filed Jan. 22, 2015, entitled "Apparatus and Method for Dynamic Control of Plated Uniformity With the Use of Remote Electric Current."

(Continued)

*Primary Examiner* — Ciel Thomas
(74) *Attorney, Agent, or Firm* — Weaver Austin Villeneuve & Sampson LLP

(57) ABSTRACT

Disclosed herein are methods of electroplating which may include placing a substrate, an anode, and an electroplating solution in an electroplating cell such that the substrate and the anode are located on opposite sides of a fluidically-permeable plate, setting the configuration of one or more seals which, when in their sealing configuration, substantially seal pores of the fluidically-permeable plate, and applying an electrical potential between the anode and the first substrate sufficient to cause electroplating on the first substrate such that the rate of electroplating in an edge region of the first substrate is affected by the configuration of the one or more seals. Also disclosed herein are apparatuses for electroplating which may include one or more seals for substantially sealing a subset of the pores in a fluidically-permeable plate whose sealing configuration affects a rate of electroplating in an edge region of the substrate.

20 Claims, 8 Drawing Sheets

(56) References Cited

U.S. PATENT DOCUMENTS

| | | | |
|---|---|---|---|
| 4,696,729 | A | 9/1987 | Santini |
| 5,078,852 | A | 1/1992 | Yee et al. |
| 5,169,684 | A | 12/1992 | Takagi |
| 5,312,352 | A | 5/1994 | Leschinsky et al. |
| 5,312,532 | A | 5/1994 | Andricacos et al. |
| 5,620,581 | A | 4/1997 | Ang |
| 5,723,028 | A | 3/1998 | Poris |
| 5,774,019 | A | 6/1998 | Koyama et al. |
| 6,004,440 | A | 12/1999 | Hanson et al. |
| 6,027,631 | A | 2/2000 | Broadbent |
| 6,071,388 | A | 6/2000 | Uzoh |
| 6,074,544 | A | 6/2000 | Reid et al. |
| 6,099,702 | A | 8/2000 | Reid et al. |
| 6,106,687 | A | 8/2000 | Edelstein |
| 6,110,346 | A | 8/2000 | Reid et al. |
| 6,126,798 | A | 10/2000 | Reid et al. |
| 6,132,587 | A | 10/2000 | Jorne et al. |
| 6,132,805 | A | 10/2000 | Moslehi |
| 6,156,167 | A | 12/2000 | Patton et al. |
| 6,162,344 | A | 12/2000 | Reid et al. |
| 6,168,693 | B1 | 1/2001 | Uzoh et al. |
| 6,174,425 | B1 | 1/2001 | Simpson et al. |
| 6,179,983 | B1 | 1/2001 | Reid et al. |
| 6,193,860 | B1 | 2/2001 | Weling |
| 6,228,231 | B1 | 5/2001 | Uzoh |
| 6,261,433 | B1 | 7/2001 | Landau |
| 6,322,674 | B1 | 11/2001 | Berner et al. |
| 6,391,166 | B1 | 5/2002 | Wang |
| 6,391,168 | B1 | 5/2002 | Ueno |
| 6,402,923 | B1 | 6/2002 | Mayer et al. |
| 6,425,991 | B1 | 7/2002 | Tran et al. |
| 6,497,801 | B1 | 12/2002 | Woodruff et al. |
| 6,527,920 | B1 | 3/2003 | Mayer et al. |
| 6,551,483 | B1 | 4/2003 | Mayer et al. |
| 6,569,299 | B1 | 5/2003 | Reid et al. |
| 6,599,412 | B1 | 7/2003 | Graham et al. |
| 6,627,051 | B2 | 9/2003 | Berner et al. |
| 6,632,335 | B2 | 10/2003 | Kunisawa et al. |
| 6,716,334 | B1 | 4/2004 | Reid et al. |
| 6,755,954 | B2 | 6/2004 | Mayer et al. |
| 6,773,571 | B1 | 8/2004 | Mayer et al. |
| 6,800,187 | B1 | 10/2004 | Reid et al. |
| 6,843,894 | B2 | 1/2005 | Berner et al. |
| 6,919,010 | B1 | 7/2005 | Mayer et al. |
| 6,988,932 | B2 | 1/2006 | Ashjaee et al. |
| 7,288,177 | B2 | 10/2007 | Barrese et al. |
| 7,323,094 | B2 | 1/2008 | Simpson et al. |
| 7,383,521 | B2 | 6/2008 | Smith et al. |
| 7,622,024 | B1 | 11/2009 | Mayer et al. |
| 7,682,498 | B1 | 3/2010 | Mayer et al. |
| 7,737,035 | B1 | 6/2010 | Lind et al. |
| 7,837,841 | B2 | 11/2010 | Chen et al. |
| 7,854,828 | B2 | 12/2010 | Reid et al. |
| 7,967,969 | B2 | 6/2011 | Mayer et al. |
| 8,262,871 | B1 | 9/2012 | Mayer et al. |
| 8,308,931 | B2 | 11/2012 | Reid et al. |
| 8,475,636 | B2 | 7/2013 | Mayer et al. |
| 8,475,637 | B2 | 7/2013 | Mayer et al. |
| 8,475,644 | B2 | 7/2013 | Mayer et al. |
| 8,603,305 | B2 | 12/2013 | Rash et al. |
| 8,795,480 | B2 | 8/2014 | Mayer et al. |
| 8,858,774 | B2 | 10/2014 | Mayer et al. |
| 9,260,793 | B2 | 2/2016 | Mayer et al. |
| 9,309,604 | B2 | 4/2016 | Mayer et al. |
| 9,567,685 | B2 | 2/2017 | Kagajwala et al. |
| 2002/0017456 | A1 | 2/2002 | Graham et al. |
| 2002/0020627 | A1 | 2/2002 | Kunisawa et al. |
| 2002/0046952 | A1 | 4/2002 | Graham et al. |
| 2002/0119671 | A1 | 8/2002 | Lee |
| 2002/0125141 | A1 | 9/2002 | Wilson et al. |
| 2003/0038035 | A1 | 2/2003 | Wilson et al. |
| 2003/0079995 | A1 | 5/2003 | Contolini et al. |
| 2003/0168340 | A1 | 9/2003 | Kaja et al. |
| 2003/0201166 | A1 | 10/2003 | Zheng et al. |
| 2004/0084316 | A1 | 5/2004 | Muranaka |
| 2004/0094427 | A1 | 5/2004 | Economikos et al. |
| 2004/0149584 | A1 | 8/2004 | Nagai et al. |
| 2005/0145499 | A1 | 7/2005 | Kovarsky et al. |
| 2005/0164498 | A1 | 7/2005 | Ide et al. |
| 2006/0201814 | A1 | 9/2006 | Hafezi et al. |
| 2006/0243598 | A1 | 11/2006 | Singh et al. |
| 2007/0029193 | A1 | 2/2007 | Brcka |
| 2008/0179180 | A1 | 7/2008 | McHugh et al. |
| 2010/0032303 | A1 | 2/2010 | Reid et al. |
| 2010/0032304 | A1 | 2/2010 | Mayer et al. |
| 2010/0032310 | A1 | 2/2010 | Reid et al. |
| 2010/0044236 | A1 | 2/2010 | Mayer et al. |
| 2010/0116672 | A1 | 5/2010 | Mayer et al. |
| 2012/0000786 | A1 | 1/2012 | Mayer et al. |
| 2012/0061246 | A1 | 3/2012 | Feng et al. |
| 2012/0258408 | A1 | 10/2012 | Mayer et al. |
| 2013/0137242 | A1 | 5/2013 | He et al. |
| 2013/0313123 | A1 | 11/2013 | Abraham et al. |
| 2013/0327650 | A1 | 12/2013 | Mayer et al. |
| 2014/0144781 | A1 | 5/2014 | He |
| 2014/0231245 | A1 | 8/2014 | Sandmann et al. |
| 2015/0060291 | A1 | 3/2015 | Mayer et al. |
| 2016/0115611 | A1 | 4/2016 | Mayer et al. |
| 2016/0215408 | A1 | 7/2016 | Kagajwala et al. |

FOREIGN PATENT DOCUMENTS

| | | | |
|---|---|---|---|
| CN | 1624207 | A | 6/2005 |
| CN | 1705774 | A | 12/2005 |
| CN | 101056718 | A | 10/2007 |
| CN | 100487855 | C | 5/2009 |
| CN | 101736376 | A | 6/2010 |
| EP | 1179617 | A1 | 2/2002 |
| JP | 2003-268591 | | 9/2003 |
| KR | 10-0707121 | | 4/2007 |
| TW | 223678 | | 11/2004 |
| TW | 201107536 | A | 3/2011 |
| WO | WO 99/14401 | | 3/1999 |
| WO | WO 99/64647 | | 12/1999 |
| WO | WO2005/043593 | | 5/2005 |
| WO | WO2010/144330 | | 12/2010 |

OTHER PUBLICATIONS

US Office Action, dated May 26, 2010, issued in U.S. Appl. No. 11/506,054.

US Notice of Allowance, dated Aug. 13, 2010, issued in U.S. Appl. No. 11/506,054.

US Office Action, dated Sep. 19, 2011, issued in U.S. Appl. No. 12/291,356.

US Final Office Action, dated Feb. 27, 2012, issued in U.S. Appl. No. 12/291,356.

US Notice of Allowance, dated Jul. 27, 2012, issued in U.S. Appl. No. 12/291,356.

US Office Action, dated Jun. 24, 2011, issued in U.S. Appl. No. 12/481,503.

US Final Office Action, dated Mar. 1, 2012, issued in U.S. Appl. No. 12/481,503.

US Office Action, dated Jul. 9, 2012, issued in U.S. Appl. No. 12/481,503.

US Final Office Action, dated Dec. 19, 2012, issued in U.S. Appl. No. 12/481,503.

US Notice of Allowance dated Mar. 1, 2013 issued in U.S. Appl. No. 12/481,503.

US Office Action, dated Jun. 24, 2011, issued in U.S. Appl. No. 12/606,030.

US Final Office Action, dated Mar. 1, 2012, issued in U.S. Appl. No. 12/606,030.

US Office Action, dated Jun. 28, 2012, issued in U.S. Appl. No. 12/606,030.

US Office Action, dated Jul. 13, 2012, issued in U.S. Appl. No. 12/606,030.

US Final Office Action, dated Dec. 17, 2012, issued in U.S. Appl. No. 12/606,030.

(56) References Cited

OTHER PUBLICATIONS

US Notice of Allowance dated Mar. 1, 2013 issued in U.S. Appl. No. 12/606,030.
US Office Action, dated Feb. 25, 2014, issued in U.S. Appl. No. 13/438,443.
US Notice of Allowance, dated Jun. 11, 2014, issued in U.S. Appl. No. 13/438,443.
Chinese First Office Action dated May 15, 2013 issued in CN Application No. 200910209697.2.
Chinese Second Office Action dated Dec. 10, 2013 issued in CN Application No. 200910209697.2.
PCT International Search Report and Written Opinion, dated Jan. 12, 2011, issued in PCT/US2010/037520.
PCT International Preliminary Report on Patentability and Written Opinion, dated Dec. 22, 2011, issued in PCT/US2010/037520.
Chinese First Office Action dated Nov. 6, 2013 issued in CN Application No. 201080032109.3.
Chinese Second Office Action dated Jun. 10, 2014 issued in CN Application No. 201080032109.3.
Taiwan Office Action dated Jul. 31, 2014 issued in TW Application No. 099118603.
US Office Action, dated Jun. 16, 2016, issued in U.S. Appl. No. 14/602,910.
US Notice of Allowance, dated Oct. 6, 2016, issued in U.S. Appl. No. 14/602,910.
US Office Action, dated Jul. 29, 2015, issued in U.S. Appl. No. 13/907,265.
US Notice of Allowance, dated Dec. 30, 2015, issued in U.S. Appl. No. 13/907,265.
US Notice of Allowance, dated Oct. 2, 2015, issued in U.S. Appl. No. 14/483,942.
US Notice of Allowance [Corrected Notice of Allowability], dated Nov. 10, 2015, issued in U.S. Appl. No. 14/483,942.
US Notice of Allowance [Corrected Notice of Allowability], dated Jan. 20, 2016, issued in U.S. Appl. No. 14/483,942.
US Office Action, dated Jan. 15, 2016, issued in U.S. Appl. No. 13/687,937.
Korean First Office Action dated Jun. 23, 2016 issued in KR 10-2012-7000614.
Chinese First Office Action dated Oct. 13, 2015 issued in CN 201210098129.1.
Chinese Second Office Action dated Jun. 6, 2016 issued in CN 201210098129.1.
Taiwan Office Action dated Nov. 10, 2015 issued in TW USSN 101111926.
Taiwan Office Action dated Aug. 2, 2016 issued in TW 101144354.
US Office Action, dated Feb. 10, 2017, issued in U.S. Appl. No. 14/067,616.
Chinese Third Office Action dated Nov. 18, 2016 issued in CN 201210098129.1.
U.S. Final Office Action, dated May 1, 2017, issued in U.S. Appl. No. 13/687,937.
Chinese First Office Action dated Mar. 31, 2017 issued in Application No. CN 201510556374.6.

Fig. 2A
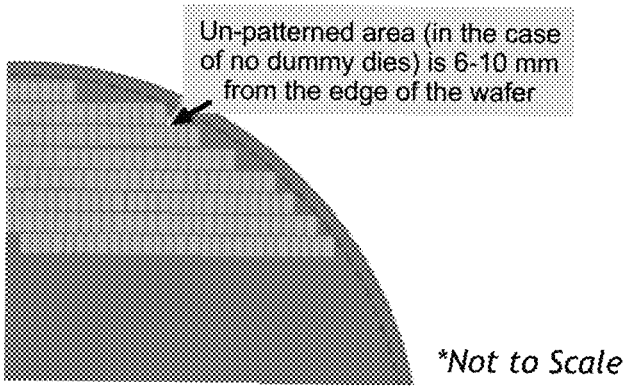
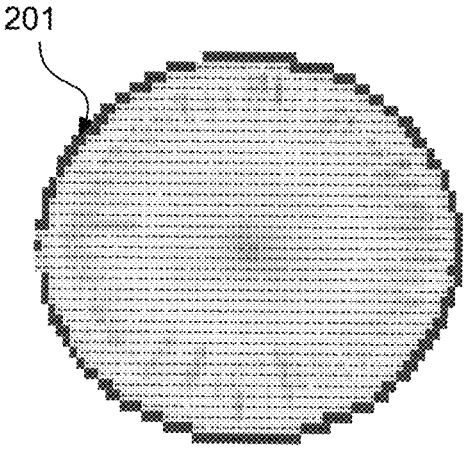
Fig. 2B
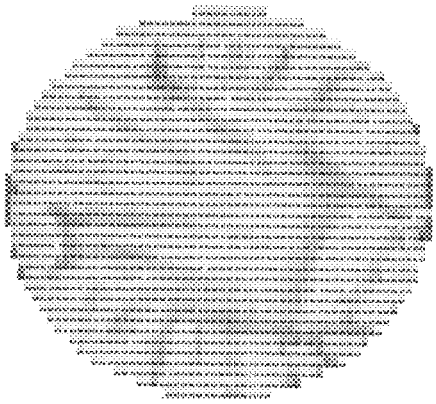
Fig. 2C

307
Wafer - 300mm
319
HRVA
351
Insert Shield - 11.45"

399
308
Wafer without dummy dies at edge
319
HRVA
351
Insert Shield - 11.45"

308
Wafer without dummy dies at edge
319
HRVA
352
Insert Shield - 10.80"

METHODS AND APPARATUSES FOR DYNAMICALLY TUNABLE WAFER-EDGE ELECTROPLATING

FIELD OF THE INVENTION

This disclosure relates to the fabrication of electronic devices, the electroplating of semiconductor substrates, and electroplating systems and apparatuses.

BACKGROUND

The fabrication of integrated circuits often involves one or more steps of electroplating a layer of conductive metal onto the surface of a semiconductor wafer. For example, in some IC fabrication procedures, an electroplating operation may be used to fill with metal the various features formed in the surface of a semiconductor wafer such as, for instance, the trenches and vias used as conductive paths between various circuit elements.

In a typical electroplating operation, the surface of the wafer is exposed to an electroplating bath fluid which contains dissolved ions of the metal to be electroplated, and an electrical circuit is created between an electrode in the bath (which serves as an anode) and surface of the wafer (which serves as the cathode). Flow of current through this circuit upon application of an applied electrical potential difference causes electrons to flow to the cathodic wafer surface and reduce dissolved metal ions in its vicinity thereby resulting in the plating out of solution of neutral elemental metal onto the surface of the wafer.

However, for this circuit to be completed and for electrochemical reduction of dissolved metal ions to occur, the surface of the wafer (serving as the circuit's cathode) must be, at least to a certain extent, relatively conductive. Accordingly, since the bare surface of a semiconductor wafer is not generally substantially conductive, the actual electroplating step in an electroplating operation (sometimes referred to as "electrofill") is often preceded by the deposition of a conductive seed layer (typically quite thin) which initially provides the necessary conductive surface. Deposition of the seed layer may be accomplished by any feasible method of depositing the seed material. Suitable methods may include, for example, physical vapor deposition (PVD), chemical vapor deposition (CVD), plasma-enhanced chemical vapor deposition (PECVD), conformal film deposition (CFD), atomic layer deposition (ALD), and the like. Oftentimes, the seed layer is separated from an insulating silicon dioxide layer or other dielectric by a barrier layer. Furthermore, oftentimes, seed layer deposition and electroplating is followed by an edge bevel removal (EBR) operation that removes seed metal deposited at the edge of the wafer where its presence is not desired.

As the semiconductor industry advances, future technology regimes are likely to require extremely thin and resistive seed layers for electroplating operations. High-resistance seed layers cause it to be much more challenging to achieve a uniform electroplating thickness/current across the wafer surface because, when very resistive seed layers are used, the potential at the edge of the wafer—i.e., at the point of electrical contact—is much greater than in the center of the wafer—further away from the electrical contact. This center to edge variation in electrical potential can lead to significantly thicker plating at the edge of the wafer versus its center, a phenomenon oftentimes referred to as the "terminal effect." The effect is undesirable, of course, because it reduces usable wafer surface area in the edge region. Future use of larger-diameter wafers may further exacerbate the problem. Thus, effective methods and apparatuses are needed for controlling ionic current during electroplating so as to better control the thickness of the metal deposited at the edge of semiconductor substrates in electroplating operations.

SUMMARY

Disclosed herein are methods of electroplating one or more semiconductor substrates in an electroplating cell. The methods may include placing a first substrate, an anode, and an electroplating solution in an electroplating cell such that the substrate and the anode are located on opposite sides of a fluidically-permeable plate, the plate having multiple pores which, when immersed in the electroplating solution, provide a fluidic connection between said electroplating solution on opposite sides of the plate. The methods may further include setting the configuration of one or more seals which, when in their sealing configuration, substantially seal a subset of the pores of the fluidically-permeable plate, the subset located in an edge region of the plate, and the methods may also include applying an electrical potential between the anode and the first substrate sufficient to cause electroplating on the first substrate, wherein the rate of electroplating in an edge region of the first substrate is affected by the configuration of the one or more seals. In some embodiments, the one or more seals, when in their sealing configuration, seal the subset of pores in the edge region by contacting the fluidically-permeable plate in the edge region. In some embodiments, the one or more seals comprise two inflatable seals which, when in their sealing configuration, are inflated so as to contact the fluidically-permeable plate in the edge region, and wherein setting the configuration of the one or more seals comprises inflating and/or deflating one or more of the seals.

Also disclosed herein are apparatuses for electroplating one or more semiconductor substrates. The apparatuses may include an electroplating cell, a substrate holder configured to hold a substrate within the electroplating cell, a fluidically-permeable plate located within the electroplating cell and oriented substantially parallel to a substrate held in the substrate holder, a power supply configured to apply an electrical potential between an anode in the electroplating cell and a substrate held on the substrate holder sufficient to cause electroplating on the substrate, and a controller comprising a processor and a memory. In some embodiments, the plate may have multiple pores which, when immersed in electroplating solution, provide a fluidic connection between electroplating solution on opposite sides of the plate. In some embodiments, the apparatus may further include one or more seals which, when in their sealing configuration, substantially seal a subset of the pores of the fluidically-permeable plate, the subset located in an edge region of the plate. In some embodiments, the controller may be configured to set the configuration of the one or more seals such that during application of electrical potential by the power supply, the rate of electroplating in an edge region of the substrate is affected by the configuration of the one or more seals.

BRIEF DESCRIPTION OF THE DRAWINGS

FIG. 2A schematically illustrates the die patterning of a semiconductor wafer wherein the patterning does not extend to the edge of the wafer.

FIG. 2B illustrates the non-uniform wafer plating which may result from electroplating a wafer with the patterning of FIG. 2A.

FIG. 2C illustrates that the excessive edge plating shown in FIG. 2B may be eliminated (or substantially reduced) by locating a shield near the edge of the wafer during electroplating.

DETAILED DESCRIPTION

In the following description, numerous specific details are set forth in order to provide a thorough understanding of the present invention. However, the present invention may be practiced without some or all of these specific details. In other instances, well known process operations or hardware have not been described in detail so as to not unnecessarily obscure the inventive aspects of the present work. While the invention will be described in conjunction with specific detailed embodiments, it is to be understood that these specific detailed embodiments are not intended to limit the scope of the inventive concepts disclosed herein.

In the following description it is also to be noted that the term "substrate" refers to any semiconductor based structure, object, or device suitable for electroplating and/or upon which electroplating may be desired. Oftentimes such a substrate is more specifically a "wafer" or a "wafer substrate" as those terms are commonly used in the art. However, for purposes of this disclosure, the terms "wafer" or "wafer substrate" are to be interpreted as referring to any "substrate" for electroplating, as just described.

Disclosed herein are improved electroplating apparatuses which employ a dynamically tunable substrate shielding feature which allows the rate of electroplating to be adjusted and/or controlled near the edge of a substrate being electroplated. Methods of electroplating one or more substrates employing such a dynamically tunable shielding feature are also described herein.

Electroplating apparatuses disclosed herein may accomplish this dynamically tunable shielding by adjusting and/or controlling the flow of ionic electroplating current through the pores of an ionically-resistive fluidically-permeable (IRFP) plate which is aligned with the surface of the substrate within the electroplating apparatus. In some embodiments, such an IRFP plate may serve as a high-resistance virtual anode (HRVA) relative to the substrate—which, of course, is the cathode. The HRVA feature is used to mitigate the terminal effect which tends to cause un-even plating, center to edge. However, the ability to configure, adjust, and/or vary flow of ionic current through certain portions of the IRFP plate may provide the mechanism for implementing the feature of dynamic shielding.

Figure 1:
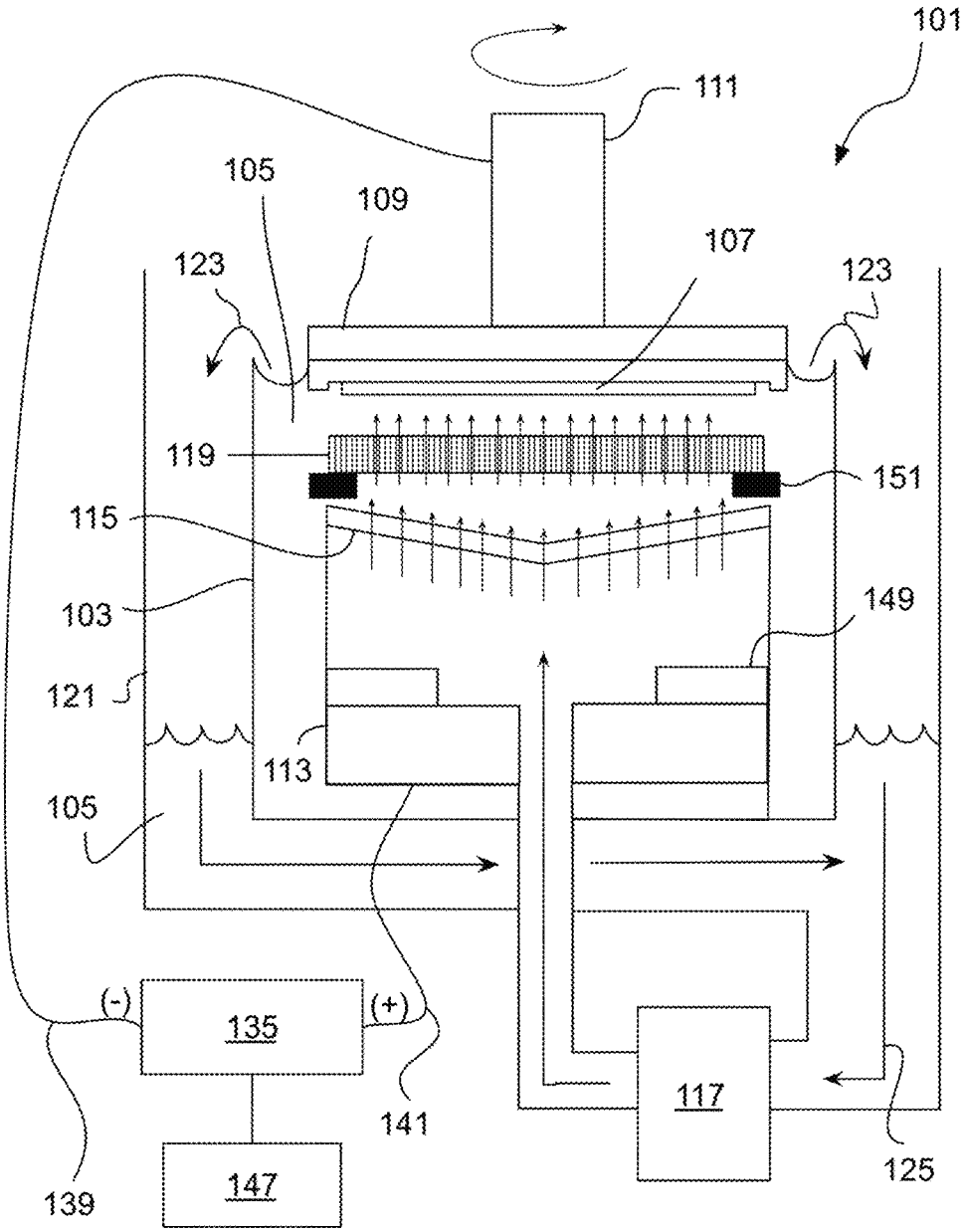
FIG. 1 schematically and cross-sectionally illustrates an example of an electroplating apparatus.

An example of an electroplating apparatus that with suitable modification may be used to implement the dynamic shielding feature is schematically illustrated in FIG. 1. As shown in the figure, such an electroplating apparatus 101 generally includes an electroplating cell 103 for holding an anode 113, a substrate 107, and an electroplating solution 105, a substrate holder 109 for holding the substrate within the electroplating cell, and a power supply 135 configured to apply an electrical potential between the anode 113 in the electroplating cell and a substrate 107 held on the substrate holder. The power supply 135 should, of course, be capable of applying a sufficient electrical potential to cause electroplating of the desired metal (making up the anode) onto the surface of the substrate 107 for the given conditions within the cell. Also shown in FIG. 1 is the aforementioned IRFP plate 119 which is shown located within the electroplating cell 103 and aligned substantially parallel to a substrate 107 held in the substrate holder 109. A more detailed description of the electroplating apparatus 101 illustrated in FIG. 1 is provided below.

Typically, the fluidic permeability of the IRFP plate 109 is the result of it having a multitude of pores—such as channels or holes through the plate—which providing a fluidic connection between one side of the plate and the other, though, in some embodiments (some of which are described below), the plate's fluidic permeability may be established by other mechanisms, such as the entire plate being made up of a porous material. In any event, when the IRFP plate is immersed in an electroplating solution, the pores provide a fluidic connection between said electroplating solution on opposite sides of the plate. A detailed description of various aspects of IRFP plates is provided below.

The presence of the IRFP plate in the vicinity of the substrate during electroplating and its particular configuration of pores affects the resistance of the plate to the flow of ionic electroplating current and thus potentially the rate of electroplating in different regions of the substrate's surface. To the extent that the plate generally resists the flow of ionic electroplating current through it and to the substrate, it may act as a high-resistance virtual anode (as mentioned above), promoting a uniform rate of electroplating center to edge. In some cases, the pattern of pores (e.g. holes) in the plate and/or the plate's porosity may vary over different regions of the plate. For example, certain regions of the plate may have higher (or lower) porosities leading to correspondingly higher (or lower) electroplating currents on the corresponding regions of the substrate surface. Higher (or lower) porosities may be achieved through having higher (or lower) pore densities, or though having larger (or smaller) pores, or both, depending on the embodiment. In any event, as indicated, dynamically tunable substrate shielding may be implemented by adjusting and/or controlling the flow of ionic current through the pores in the IRFP plate thereby tuning the electroplating rates in corresponding regions of the wafer's surface.

The ability to adjust and/or tune the rate of electroplating on the portion of the substrate's surface near to its edge (i.e., in the edge region of the substrate) is particularly beneficial. One reason such edge tuning is useful is that some substrates requiring electroplating may not be patterned out to their edge. An example is shown in FIG. 2A. In a typical wafer layout, the entire wafer is patterned with dies out to the edge (or nearly so), even though the dies patterned in the edge region are "dummy dies" that will not become functional products. Together, the functional and dummy dies create a uniform surface for electroplating—e.g., of similar conductivity—so that electroplating will occur over the entire substrate surface, even out to the edge (or nearly so). However, depicted in FIG. 2A is the scenario of a wafer which is not patterned out to its edge with dummy dies. In this particular example, the un-patterned area is about 6-10 mm from the edge of the wafer as indicated in the figure (though generally this obviously depends on the size and rectangularity of the dies).

A lack of patterning in an edge region of the wafer is significant because, in a typical scenario, the un-patterned area remains covered with photoresist, and so it is not conductive and thus will not be plated upon in an electroplating operation. Of course, the non-plating of the unused edge region would not in itself be a problem, but the issue is that this lack of plating in the edge region causes excessive plating in the patterned region immediately adjacent to it (i.e., just radially inward).

FIG. 2B illustrates this increase in plating thickness via the darkened ring 201 around the edge of the wafer. This is a typical result which occurs because ordinary electroplating apparatuses employ a static/fixed-size insert shield which, although appropriate for a wafer patterned with dummy dies, may not be appropriate for a wafer lacking the dummy die patterning out to the edge. An example of such a static/fixed-size insert shield—in particular, a static backside insert shield—is shown schematically as shield 151 in FIG. 1 (located adjacent to the IRFP plate, on the side of the plate opposite the substrate).

One solution to this problem is to manually install a differently sized insert shield. FIG. 2C illustrates—relative to FIG. 2B—that if one instead uses a smaller insert shield, the increase in edge plated thickness is eliminated (or at least substantially reduced). Thus, since use of a smaller insert shield remedies the problem, it is seen that the lack of edge patterning is analogous to what would occur if a smaller diameter wafer is plated in an electroplating apparatus configured to plate a larger diameter wafer.

Figures 3A, 3B, 3C:
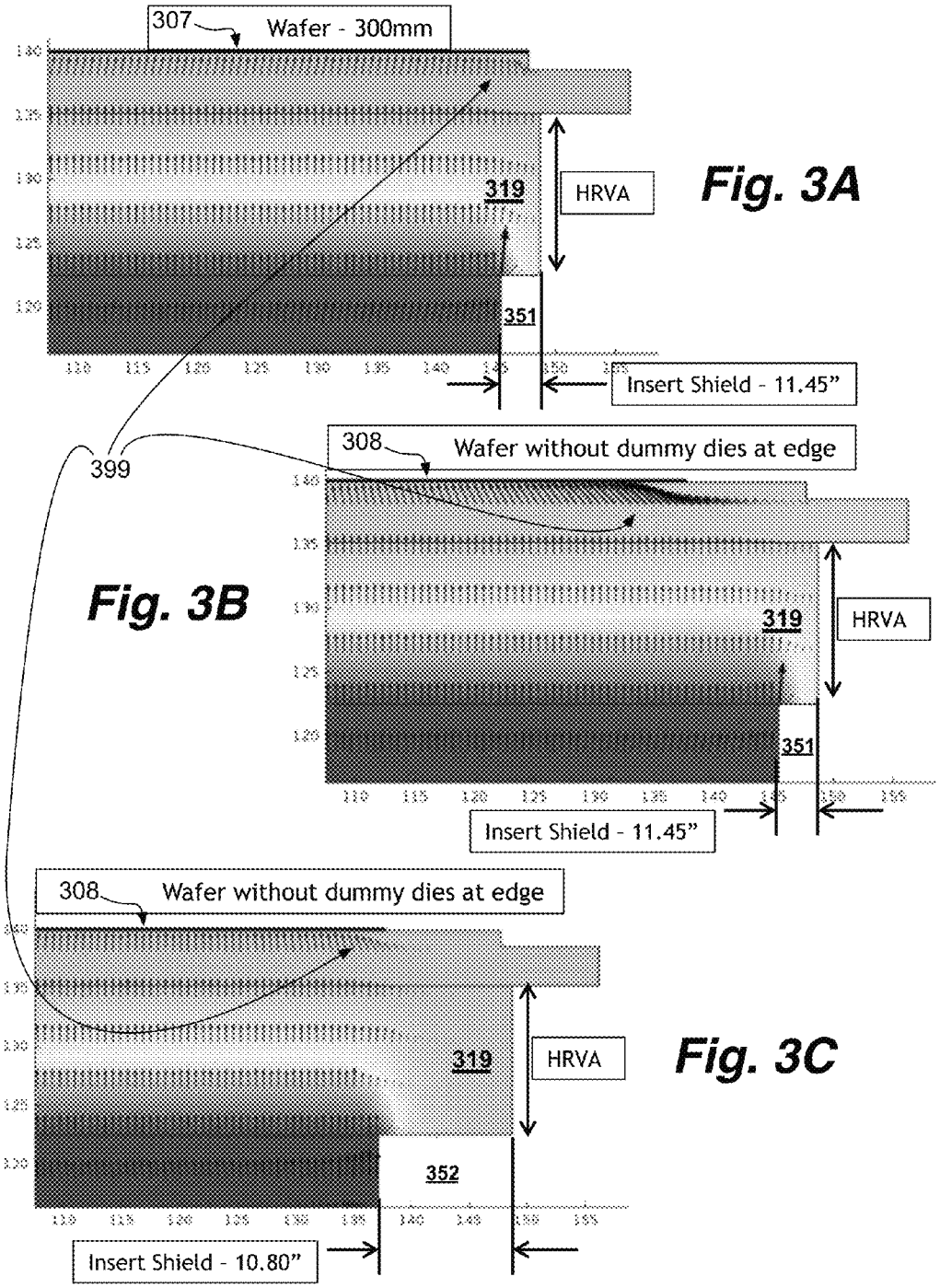
FIG. 3A displays a cross-sectional view of wafer, electroplating apparatus, and ionic current which results from the simulated electroplating of a 300 mm wafer using a 11.45" insert shield.
FIG. 3B displays a cross-sectional view of wafer, electroplating apparatus, and ionic current which results from the simulated electroplating of a 280 mm wafer using a 11.45" insert shield.
FIG. 3C displays a cross-sectional view of wafer, electroplating apparatus, and ionic current which results from the simulated electroplating of a 280 mm wafer using a 10.80" insert shield.

The effect is also illustrated in FIGS. 3A through 3C. These figures show cross-sectional views of an electroplating apparatus holding a substrate 307 or 308 with arrows 399 overlaid on the cross-sections indicating electroplating ionic current, as determined through simulation. Also, specifically displayed in each cross-sectional view is IRFP plate 319 (in this case, indicated to be a high-resistance virtual anode (HRVA)), and a fixed/static insert shield 351 or 352 (see shield 151 in FIG. 1). FIG. 3A illustrates the electroplating ionic current which results from using a 11.45" insert shield 351 when electroplating the 300 mm wafer 307. In this case, the arrows 399 indicating electroplating current density show that the rate of electroplating is quite uniform across the surface of wafer 307, and in particular, the electroplating current near the wafer's edge, as indicated by the arrows, is nearly the same as the electroplating current at the wafer's center.

However, this is not the case with the simulation shown in FIG. 3B. In FIG. 3B, the electroplating of a 280 mm wafer 307 is simulated with the same 11.45" insert shield 351—the smaller wafer size modeling the effect of a 300 mm wafer patterned without dummy dies in its edge region. Here, the phenomenon of "current crowding" is clearly exhibited, where the electroplating current is seen to converge and have much greater density in the immediate vicinity of the edge. Such current crowding thus leads to undesirable center to edge non-uniformity in the plated material as shown in FIG. 2B, specifically thicker plating in the radially outermost portion of the wafer's surface which is pattered and not blanketed with photoresist.

Finally, FIG. 3C illustrates that the effect may be remedied—similar to FIG. 2C—by using the smaller 10.80" fixed/static insert shield 352. Here, the electroplating current near the edge of the smaller 280 mm wafer 308—as indicated by the arrows 399 in FIG. 3C—is nearly back to what was illustrated for the 300 mm wafer 307 in FIG. 3A—i.e., approximately uniform electroplating current, center to edge, across the whole wafer.

Figure 4A:
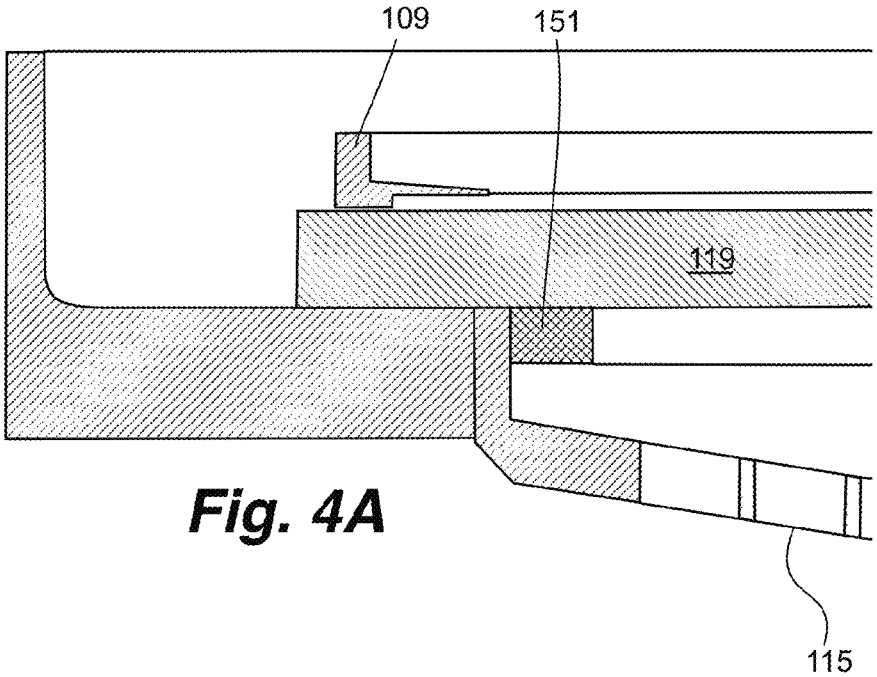
FIG. 4A schematically illustrates an close-up view of a portion of an electroplating apparatus having a static insert shield underneath and adjacent to the apparatus's ionically-resistive fluidically-permeable plate.

Thus, one way of dealing with the "current crowding" problem is to manually change the "shielding" of the cell by adding or removing one or more static fixed-size shields which, when in place, act to effectively block the flow of electroplating current in the vicinity of the edge of the wafer. Shield 151 in FIG. 1 is one example. An example illustrated in greater detail is shown in FIG. 4A. Similar to the shield shown in FIG. 1, FIG. 4A shows static fixed-size shield 151 underneath and adjacent to IRFP plate 119, located between it and the anode membrane 115—located below it in the figure. On the other side of the plate 119—above it in the figure—is wafer holder 109. Static fixed-size shield 151, by being adjacent to and blocking a portion of the plate 119, prevents (or at least substantially reduces) ionic current flow through this region of the plate. Use of a static fixed-size shield, however, requires that the electroplating apparatus be taken offline, reconfigured, and then recalibrated every time a new type of wafer with a different edge patterning is desired to be plated, resulting in substantial downtime and decreased throughput if this switch happens with some frequency.

An alternative is to compensate for changes in wafer edge patterning by dynamically changing the shielding in the vicinity of the edge of the wafer. While there are a variety of ways to accomplish this, one particularly effective technique is to set and/or adjust the configuration of a set of one or more seals which, when in their sealing configuration, substantially seal certain pores of the IRFP plate, specifically, pores in an edge region of the plate. By sealing these pores such that the fluidic connection they provide is broken (or at least substantially reduced), resistance to ionic current flow in the plate's edge region is increased which results in a reduction in electroplating rate in a corresponding edge region of the wafer. In this manner, it is feasible to tune the rate of electroplating in an edge region of the wafer depending on application—in particular, depending on the edge patterning exhibited by the wafer to be plated.

Thus, consistent with this approach, a series of substrates may be electroplated by selecting a first substrate for electroplating, setting an appropriate configuration of the aforementioned seal(s) to select an appropriate level of substrate edge shielding, placing the first substrate in the substrate holder of the electroplating apparatus, and applying an electrical potential between the anode and the first substrate sufficient to cause electroplating on the first substrate. After completion of the electroplating of the first substrate, such an approach may then proceed by selecting a second substrate for electroplating which potentially may have a diameter significantly different than the diameter of the first substrate, replacing the first substrate with the second substrate in the substrate holder, adjusting the configuration of the one or more seal(s) to select an appropriate level of substrate edge shielding for the second substrate, and finally applying an electrical potential between the anode and the second substrate sufficient to cause electroplating on the second substrate. Once the second substrate is finished electroplating, such a method of processing a series of substrates may continue in this manner, selecting appropriate shielding conditions and electroplating additional substrates, until the whole series of substrates are electroplated as desired.

Figure 4B:
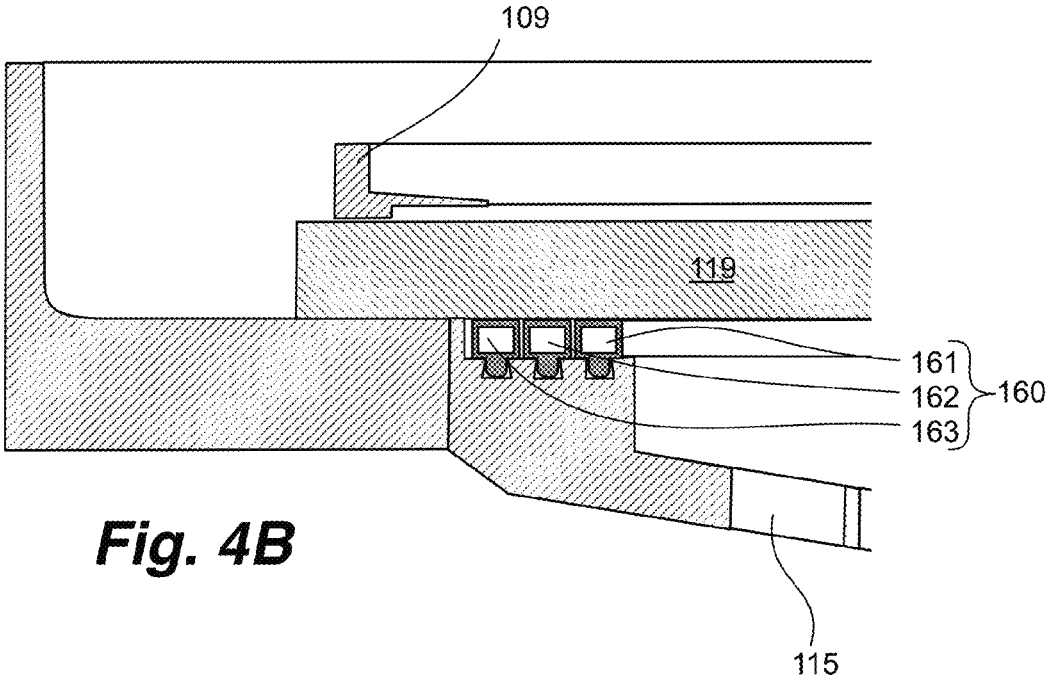
FIG. 4B displays a close-up view of a portion of an electroplating apparatus having a trio of inflatable seals underneath and adjacent to the apparatus's ionically-resistive fluidically-permeable plate, which implement the dynamically variable shielding feature disclosed herein.

One particular example of an electroplating apparatus having a group of seals for sealing pores in an edge region of the apparatus's IRFP plate—so as to affect the aforementioned adjustment and/or control of ionic current near the edge of wafer being electroplated and to implement the foregoing approach—is shown in FIG. 4B, which provides a close-up view similar to FIG. 4A. It is seen in FIG. 4B that the static fixed-size shield 151 of FIG. 4A has been replaced by a trio of inflatable seals 160—individually, 161, 162, and 163—located progressively radially outward towards the edge of plate 119. When these seals 160 are inflated so as to be in their sealing configuration, the seals contact the IRFP plate 119 in an edge region of the plate and seal pores in this region, thereby blocking (or substantially reducing) ionic current flow. Conversely, when a seal is deflated, a gap is created between the seal and the surface of the IRFP plate, thereby allowing ionic current to flow. In any event, in this particular embodiment, configuring the seals to affect ionic current flow in the desired manner involves inflating and/or deflating one or more of seals 160.

Figure 5A:
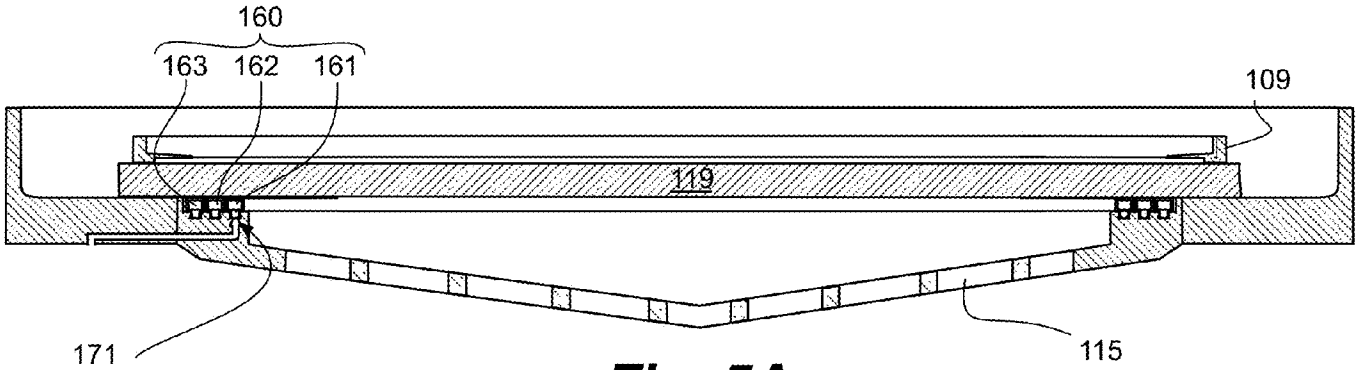
FIG. 5A displays a far-away view of the electroplating apparatus of FIG. 4B showing the ionically-resistive fluidically-permeable plate, trio of inflatable seals, anode membrane, and substrate holder.
Figure 5B:
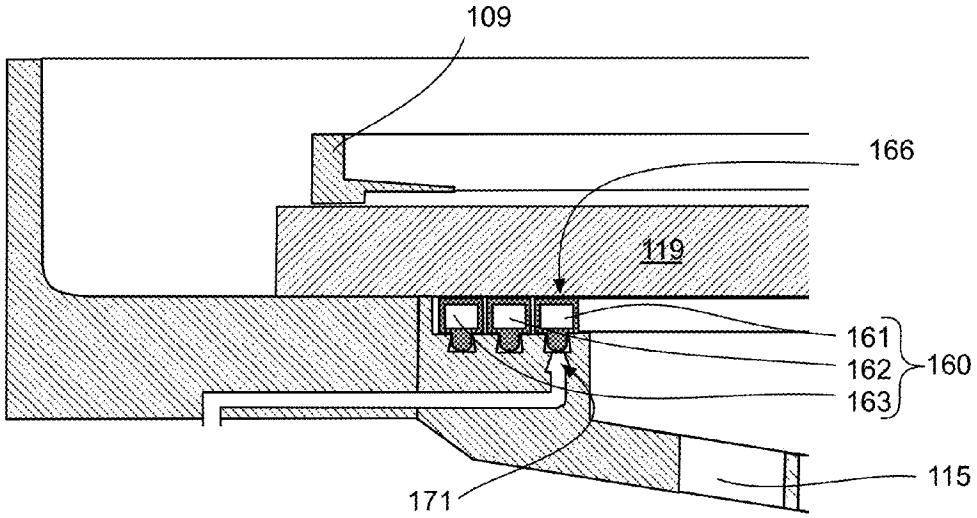
FIG. 5B displays a view of the electroplating apparatus of FIGS. 4B and 5A which schematically illustrates one of the pneumatic control lines for inflating (and deflating) one of the inflatable seals.

A far-away view of the IRFP plate 119 and inflatable seals 160, as well as anode membrane 115 and substrate holder 109, is displayed in FIG. 5A. Although still a cross-sectional view, the figure illustrates that the seals are ring-shaped and oriented such that their center axes substantially align with the center axis of a wafer which would be held by substrate holder 109 in the electroplating cell. Thus, the configuration of the seals has a radially symmetric effect on the rate of electroplating in an edge region of the substrate. In some embodiments, consistent with this figure, this edge region of the substrate—within which the rate of electroplating is affected by the configuration of the seals—may be from the substrate's edge to about 0.5 inch of its edge. Likewise, consistent with the figure, the edge region of the IRFP plate—within which pores are sealed via contact with the seals—may be from the plate's edge to about 2 inches of its edge. [FIG. 5A also illustrates a pneumatic control line 171 for seal 161. Air (or some other fluidic medium) travels through pneumatic control line 171 to inflate or deflate seal 161 as appropriate. The other seals, 162 and 163, also have dedicated pneumatic control lines in this particular embodiment (though they are not visible in the view shown by these figures). A close-up view of seals 160 and pneumatic control line 171 is shown in FIG. 5B.

Referring again to FIGS. 5A and 5B, it is seen that seals 160 each have a contact side adjacent to the IRFP plate 119—e.g., side 166 of seal 161—which is configured to contact the plate when each seal is inflated (in its sealing configuration). Depending on the embodiment, the contact side of each seal may have a radial width of between about 0.1 and 1 inch or, more particularly, between about 0.1 and 0.5 inches, or yet more particularly, between about 0.2 and 0.4 inches. As described above, each seal's contact with the IRFP plate works to seal the particular pores in the plate which are contacted by the contact side of the applicable seal (or, more precisely, the pores whose whole opening to the face of the plate are covered by the contact side of the applicable seal). Moreover, in the embodiment shown in FIGS. 5A and 5B, the particular pores which may be sealed by a particular seal, 161, 162, and 163, are located progressively further outwards towards the edge of the plate, thereby affecting the electroplating rate progressively further outwards on the surface of the substrate. Again, the utility of this configuration is that it provides dynamically adjustable shielding in the edge region of a substrate being electroplated so that how far radially outward towards the substrate's edge electroplating is allowed to occur unhindered may be adjusted depending on the patterning in the substrate's edge region. For instance, one may configure seals 161 and 162 as un-sealed and seal 163 as sealed so that electroplating occurs on the substrate out to the region on the wafer roughly aligning with seal 162 (but generally not past this into a region on the wafer roughly aligning with seal 163).

In conjunction with the addition of a dynamically controlled pore sealing mechanism, in some embodiments, an IRFP plate may be employed which exhibits a non-constant porosity over its surface. This may be in order to enhance the variable shielding effect of the seals. In particular, in some embodiments, an IRFP plate may be used which has a greater average porosity in its edge region (where pores may be sealed) than the average porosity over one or more other portions of the plate (or all other portions of the plate). Increased porosity in the edge region may be accomplished through greater pore number density per unit area, or by increasing the average size of the pores, or both, depending on the embodiment. In some embodiments, the average porosity in the edge region may be at least about 1.1 times the average porosity over the other portions of the plate. In some embodiments, the average porosity in the edge region may be at least about 1.2 times, or more particularly at least about 1.5 times, or still more particularly at least about 2.5 times, or yet still more particularly at least about 3 times the average porosity over the other portions of the plate. Suitable IRFP plates, some with non-constant porosities and other features, are discussed in further detail below.

Examples of Using Dynamically Tunable Shielding to Compensate for Wafers Having Different Degrees of Edge Patterning FIGS. 6 and 7 present the results of simulations illustrating the effects of various seal configurations on wafer electroplating, and in particular, on ionic current density perpendicular to the wafer surface (in the z-direction). Each simulation corresponds to the use of an IRFP plate having a porosity in the plate's edge region where the seals are located of double the porosity in the interior portions of the plate. The various seal configurations correspond to an apparatus having three seals with 0.25" contact sides, as shown in FIGS. 4 and 5.

Figures 6A, 6B:
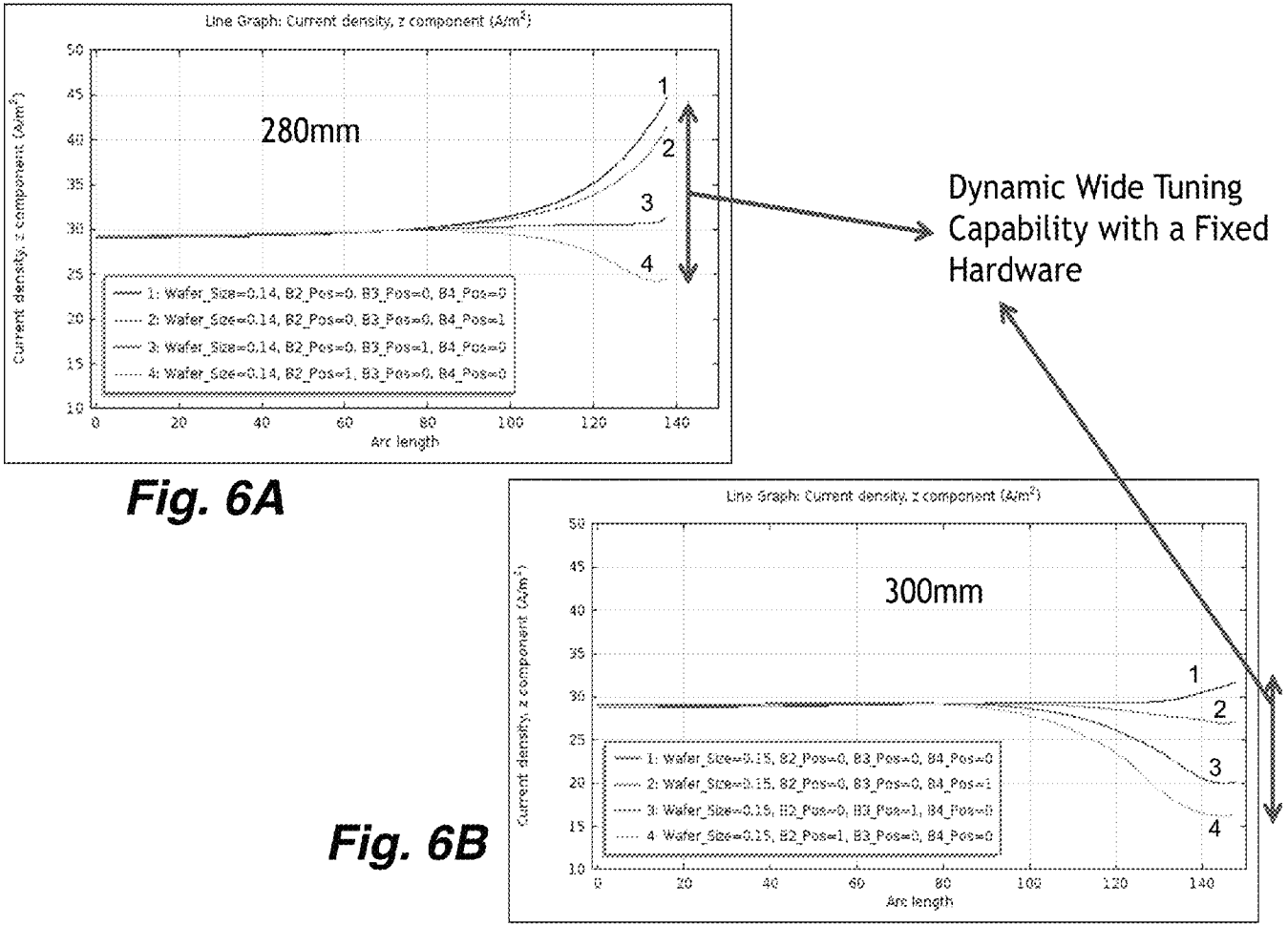
FIG. 6A displays a plot ionic current density as a function of wafer surface radial coordinate ("Arc length") for the simulated electroplating of a 280 mm wafer using different configurations of the apparatus's three inflatable seals.
FIG. 6B displays a plot analogous to that shown in FIG. 6A but for a 300 mm wafer.

FIG. 6A plots ionic current density as a function of wafer surface radial coordinate ("Arc length") for the simulated electroplating of a 280 mm wafer, using different configurations of the three seals (see seals 160 in FIGS. 4 and 5). FIG. 6B shows an analogous plot for a 300 mm wafer. Each figure presents four configurations (labeled 1 through 4) of the three seals (labeled "B2," "B3," and "B4" in the figures' legends) which correspond, respectively, to seals 161, 162, and 163 in FIGS. 4 and 5. Also, referring to the figures' legends, "Pos=1" refers to the designated seal being closed (breaking fluidic connections through the IRFP plate), and "Pos=0" refers to the designated seal being open (allowing fluidic and thus electrical connections).

In configuration 1 shown in FIGS. 6A and 6B, all seals are configured with "Pos=0" and so are open, allowing the free flow of ionic current through all pores in the plate's edge region and hence the greatest ionic current near the edge of the wafers—both for the 280 mm wafer in FIG. 6A and the 300 mm wafer in FIG. 6B. This results in good uniform electroplating for the 300 mm wafer in FIG. 6B, but too much plating at the edge of the 280 mm wafer in FIG. 6A. Seal configuration 2 in these figures corresponds to the radially outermost of the three seals being closed which, in this case, leads to results similar to configuration 1, with just slightly less plating at the edge of the 280 mm wafer in FIG. 6A, while doing equally well (or better) with the 300 mm wafer in FIG. 6B.

Configuration 3, however, where the middle of the 3 seals is closed, results in significantly more uniform plating for the 280 mm wafer in FIG. 6A, but leads to too little plating at the edge of the 300 mm wafer in FIG. 6B. Contrasting configuration 2 with configuration 3 thus illustrates the benefit of dynamically tunable shielding—configuration 2 working quite well for the 300 mm wafer, but configuration 3 working dramatically better for the 280 mm wafer.

Finally, it is noted that configuration 4, where the radially innermost seal is closed, results in too little plating in the edge region of both wafers. It should also be noted that closing the radially innermost seal, seal 161, also blocks ionic current flow through the pores regulated directly by seals 162 and 163 due to their being no fluidic path to these pores when seal 161 is closed, irrespective of whether seals 162 and 163 are open or closed. This is evident from the construction of the portions of the electroplating apparatus housing the inflatable seals, as shown in FIGS. 4 and 5. Likewise, it is also true, in this particular embodiment, that closing seal 162 necessarily results in blocking ionic current flow through the pores directly regulated by seal 163. In any event, to summarize, FIGS. 6A and 6B illustrate the capability of using dynamically configurable seals to address the edge plating problems presented by wafers having different degrees of edge patterning.

Examples of Using Dynamically Tunable Shielding to Compensate for the Terminal Effect as Amplified by the Use of Thin Seed Layers FIGS. 7A through 7D also provide plots of simulated ionic current density (perpendicular to the wafer surface in the z-direction) versus wafer surface radial coordinate ("Arc length"). The results presented in the four subfigures A through D correspond to four seal configurations ranging from all seals closed (i.e., inflated) to all seals open (i.e., deflated). Within each subfigure, the different plot lines correspond to 4 different seed layer thicknesses ranging from 500 Å (Angstroms) to 2000 Å.

It is well-understood in the art that because thinner seed layers are more resistive, they amplify the terminal effect problem (as described above) which results in too much plating in the wafer edge region (which is closer to the electrical leads). These figures illustrate that the use of dynamically tunable shielding may be used to compensate for the different degrees of terminal effect as results from the different seed layer thicknesses. Specifically, for each of the four different seed layer thicknesses of 500 Å, 1000 Å, 1500 Å, and 2000 Å, it is seen that a configuration of the 3 seals may be chosen from one of the four figures, FIGS. 7A, 7B, 7C, and 7D, which results in an ionic current density curve which is roughly uniform for that particular seed layer thickness, across the full wafer surface (ranging from 0 to 150 mm in the radial coordinate—i.e., "Arc length").

Figure 7A:
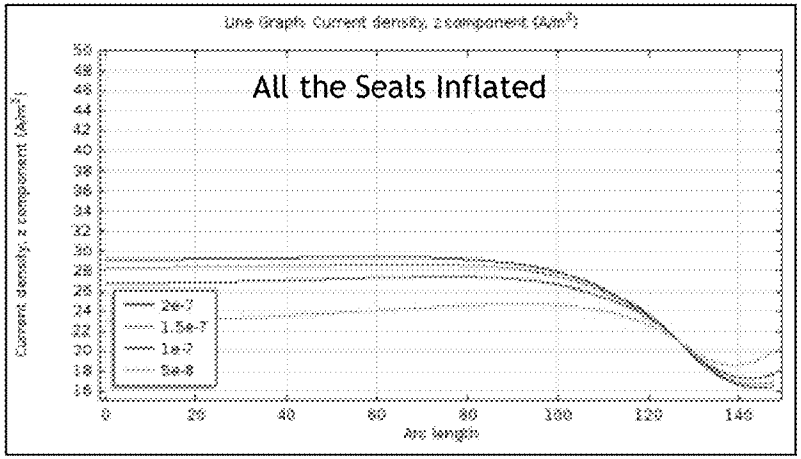
FIGS. 7A through 7D display plots of simulated ionic current density (perpendicular to the wafer surface in the z-direction) versus wafer surface radial coordinate ("Arc length") corresponding to four different configurations of the apparatus's seals, each configuration applied to 4 different seed layer thicknesses ranging from 500 Å to 2000 Å.
Figure 7B:
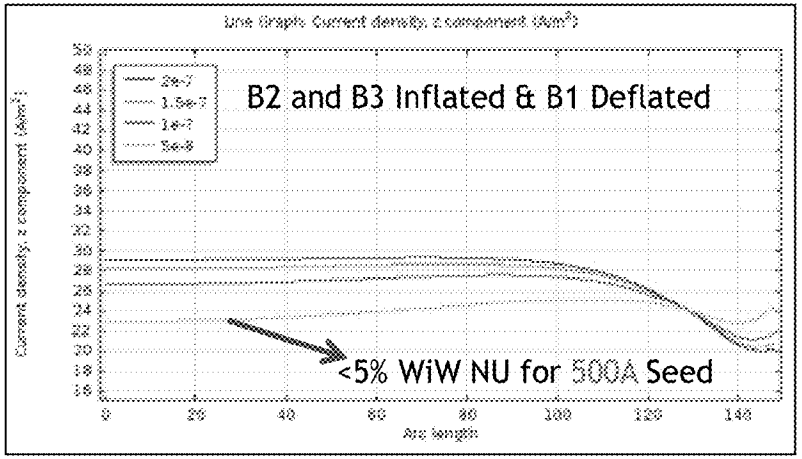
Figure 7C:
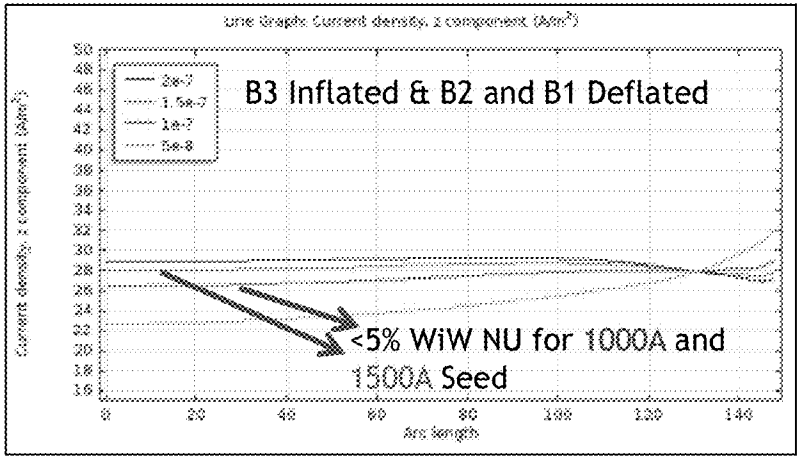
Figure 7D:
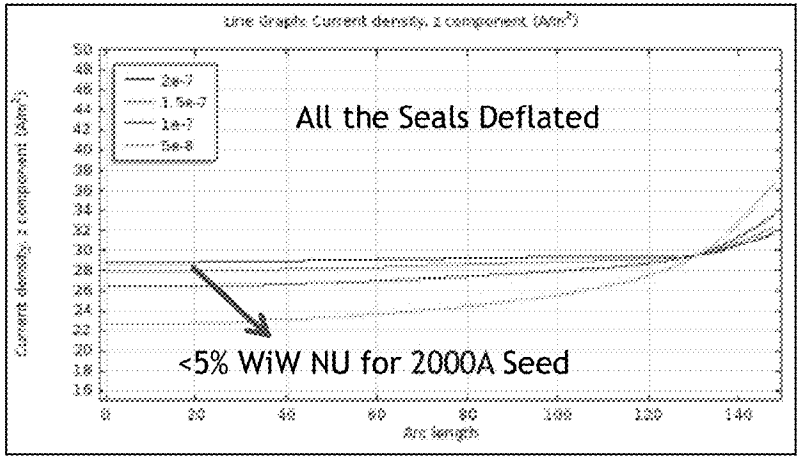

Referring first to FIG. 7A, which displays results for the configuration with all seals closed (inflated), it is seen that this configuration does not yield an optimally uniform across-wafer plating thickness for any of the different seed layer thicknesses (500 Å-2000 Å). However, FIG. 7B, shows that the configuration with seal B1 (seal 161 in FIGS. 4 and 5) open (deflated) and seals B2 and B3 (seals 162 and 163 in FIGS. 4 and 5) closed (inflated) achieves quite uniform center to edge plating for the wafer with a 500 Å seed, giving a within wafer (WiW) non-uniformity (NU) of less than 5%, as indicated in FIG. 7B. It is noted that the other seed-layer thicknesses shown in FIG. 7B for this seal configuration do not exhibit as good a uniformity. However, referring now to FIG. 7C, it is seen that by additionally opening (deflating) seal B2 (seal 162 in FIGS. 4 and 5) a non-uniformity of less than 5% may be achieved for both the 1000 Å and 1500 Å seed layer thicknesses. Finally, it is seen in FIG. 7D that having all seals open (deflated)—i.e., additionally deflating seal B1 relative to the configuration of FIG. 7C—provides the best WiW NU for the 2000 Å seed, achieving a value of less than 5% across the wafer. In short, FIGS. 7A through 7D illustrate that dynamically tunable shielding through the adjustment of seal configuration can provide excellent WiW NU (of less than 5%) over the full range of different simulated seed layer thicknesses (500 Å-2000 Å), and that this result is not achievable through the use of a static fixed-size shielding configuration.

Additional Electroplating Methods Employing Dynamically Tunable Shielding

Another potential advantage of dynamically tunable substrate shielding (at least in some embodiments) is the capability of changing the substrate shielding during the course of an electroplating operation as performed on a single substrate. This may be useful, for instance, if a wafer is such that it would be optimally electroplated under a shielding condition which is intermediate between those provided by the set seal configurations of the electroplating apparatus. Despite the fact that the optimal shielding configuration is not available, an apparatus implementing a dynamically tunable shielding feature may nevertheless approximate the optimal intermediate level of shielding by time-averaging the shielding provided by the two closest seal configurations. Thus, during the electroplating of such a substrate which may benefit from intermediate shielding, the configuration of an apparatus's seals may be adjusted multiple times over the course of the electroplating operation in order to vary the rate of electroplating in said substrate's edge region multiple times so that the time average rate of electroplating is improved.

Detailed Example of an Electroplating Apparatuses

FIG. 1 schematically illustrates a specific embodiment of an apparatus for electroplating which may employ certain embodiment methods of electroplating disclosed herein. The illustrated electroplating apparatus 101 includes an electroplating cell 103 that contains the electroplating solution 105 and an anode during electroplating. A wafer 107 may be immersed in the electroplating solution while held by a "clamshell"-type substrate holder 109, the clamshell mounted on a rotatable spindle 111. The rotatable spindle allows for rotation of substrate holder 109 together with the wafer 107. Once again, the SABRE™ system available from Lam Research Corp., aspects of which are described in U.S. Pat. No. 6,156,167, incorporates a clamshell-type electroplating apparatus. Aspects of clamshell-type electroplating apparatuses are further described in U.S. Pat. No. 6,800,187. Both of the foregoing patents are hereby incorporated by reference in their entirety for all purposes. Of course, wafer holders other than clamshell-type fixtures may alternatively be employed.

The anode 113 is disposed below the wafer 107 within the electroplating cell 103 and is separated from the wafer region by an anode membrane 115, which is an ion selective membrane in some implementations. The region below the anode membrane is often referred to as an "anodic region" or as an "anode chamber" and electrolyte within this chamber as "anolyte," while the region above the anode membrane is often referred to as a "cathodic region" or as a "cathode chamber" and the electrolyte within this chamber as "catholyte." The anode membrane 115 allows ionic communication between the anodic and cathodic regions of the electroplating cell, while preventing any particles generated at the anode from entering the proximity of the wafer and contaminating it. The anode membrane may also be useful in redistributing current flow during the electroplating processes and thereby improve electroplating uniformity. Anode membranes are further described in U.S. Pat. No. 6,126,798 and U.S. Pat. No. 6,569,299, both of which are hereby incorporated by reference in their entirety for all purposes.

The electroplating solution may be continuously provided to electroplating cell 103 by a pump 117. Generally, the electroplating solution flows upwards through an anode membrane 115 and an IRFP plate 119 to the center of wafer 107 and then radially outward and across the wafer. In some implementations, the electroplating solution may be provided into the anodic region of the electroplating cell from the side of the electroplating cell. In some implementations, the electroplating solution may be supplied through separate inlets into anodic and cathodic regions of the electroplating cell.

The IRFP plate 119 may be located in close proximity of the wafer (within about 10 millimeters or between about 3 to 8 millimeters, in various embodiments) and may serve as a constant current source to the wafer. That is, the IRFP plate 119 shapes the ionic current near the wafer to provide a relatively uniform current distribution over the wafer surface. The element may contain a plurality of one-dimensional through holes, as described further below. Further details regarding IRFP plates may be found in U.S. patent application Ser. No. 12/291,356, titled "METHOD AND APPARATUS FOR ELECTROPLATING," and filed Nov. 7, 2008, which is hereby incorporated by reference in its entirety for all purposes. In addition, further details regarding IRFP plates are provided below.

After the electroplating solution flows across the surface of the wafer, some of the solution may overflow the electroplating cell 103 to an overflow reservoir 121, as indicated by arrows 123. The electroplating solution may be filtered (not shown) and returned to pump 117, as indicated by arrow 125, completing the recirculation of the electroplating solution.

During electroplating, of course, current is supplied to the wafer surface so that the electrochemical reduction of whatever metal is being plated (e.g., $Cu^{2+}+2e^{-}\rightarrow Cu$) may occur. Thus, a DC power supply 135 can be used to control current flow to the wafer 107. The power supply 135 has a negative output lead 139 electrically connected to the wafer 107 through one or more slip rings, brushes, or contacts (not shown). The positive output lead 141 of the power supply 135 is electrically connected to the anode 113 located in electroplating cell 103. The power supply may have an output voltage of up to about 250 volts, for example. During use, the power supply 135 biases the wafer 107 to have a negative potential relative to the anode 113. This causes an electrical current to flow from the anode 113 to the wafer 107. The electrical circuit described above may also include one or several diodes that will prevent reversal of the current flow, when such reversal is not desired.

The power supply 135 may be connected to a controller 147, which allows modulation of current and electrical potential provided to the elements of the electroplating module 101. For example, the controller may allow electroplating either in current-controlled or potential-controlled regimes. The controller 147 may include program instructions specifying current and voltage levels that need to be applied to various elements of the electroplating module, as well as times at which these levels need to be changed. For example, it may include program instructions for transitioning from potential-control to current-control upon immersion of the wafer into the electroplating solution. Controllers for electroplating apparatuses like that shown in FIG. 1—as well as for controlling electroplating systems in which the apparatus of FIG. 1 may serve as one or more electroplating modules—are described in further detail below.

Another optional feature of an electroplating module are one or more shields, such as shield 149, which in the embodiment shown in FIG. 1 is located adjacent to the anode 113 in the anode chamber—i.e., on the side of the anode membrane 115 opposite to the IRFP plate 119 and wafer 107. Also shown in FIG. 1 is a removable physical shield 151 positioned within the electroplating cell 103 adjacent to the IRFP plate 119. In general, such a removable shield would reside about the perimeter of the IRFP plate to aid in center to edge plating uniformity, as described in detail above. In some implementations, such a removable shield may reside directly on the IRFP plate. In some implementations, a shield may be positioned adjacent to the IRFP plate to block ionic current through some subset of the pores of the IRFP plate, in particular, in an edge region of the IRFP plate. Although, shield 151 is depicted generically in FIG. 1 as being a manually installed fixed shield, it is noted that a shield so located and oriented in the electroplating apparatus of FIG. 1 could also be a dynamically adjustable shield which includes one or more dynamically configurable seals for sealing pores in IRFP plate 149, as described in detail above with respect to FIGS. 4 and 5.

Detailed Description of Ionically-Resistive Fluidically-Permeable Plates

Various features and characteristics of ionically-resistive fluidically-permeable (IRFP) plates which are used in electroplating apparatuses to affect flow of ionic current to a substrate during an electroplating operation are now described. Depending on the embodiment, many of these features and characteristics are suitable for the IRFP plate 119 of the electroplating apparatus of FIG. 1.

In various embodiments, a flat IRFP plate having multiple pores is deployed within the electroplating apparatus a short distance from the plating surface, e.g., the flat surface of the IRFP plate is about 1-10 mm from the plating surface. The dimension of the plate parallel to the substrate surface may be substantially coextensive with the substrate (e.g., the plate may have a diameter of about 300 mm when used with an apparatus for plating 300 mm substrates, or 450 mm when used for plating 450 mm substrates, etc.).

In various embodiments, the apparatus may provide very high vertical flow rates through the multiple pores in the IRFP plate. In various embodiments, these pores are holes in the IRFP plate that are independent of one another (i.e., non-interconnecting—there is no (or little) fluidic communication between individual holes) and are oriented in a primarily vertical orientation to direct flow upwards at the wafer surface a short distance above the pore exit. Typically, there are many such pores in the IRFP plate, often at least about 1000 such pores, or even at least about 5000 such pores; generally, there may be between about 1,000 to 25,000 such pores.

Electrolyte flowing out of these pores may produce a set of individual "microjets" of high velocity fluid that directly impinge on the wafer surface. In accordance with specific embodiments described herein, the flow rate of fluid emanating from an individual pore in the IRFP plate in the direction perpendicular to the wafer surface is on the order of about 10 cm/second or greater, more typically about 15 cm/second or greater. In some cases, it is about 20 cm/second or greater. When operating at such high vertical flow rates through the IRFP plate, high plating rates can be attained, typically on the order of about 5 micrometers/minutes or higher, particularly in a feature being formed in a through resist layer of photoresist, e.g., with a 1:1 aspect ratio and say 50 microns deep.

The distance from the plate (and the pores of the plate) to the wafer surface is generally less than 10 mm, thereby minimizing any potential dissipation of the above stated fluid velocity before striking the wafer surface. In certain embodiments, a wafer holder and associated positioning mechanism hold a rotating wafer very close to the IRFP plate. In typical cases, the separation distance is about 1-10 millimeters, or about 2-8 millimeters.

The overall volumetric flow passing through the IRFP plate is directly tied to the linear flow rate from the individual holes in the plate. For an IRFP plate of about 300 mm diameter having a large number of equal diameter holes, a volumetric flow through the plate holes may be greater than about 5 liters/minute, or greater than about 10 liter/minute, or sometime as great as 40 liters/minute or higher. As an example, a volumetric flow rate of 24 liters/minute produces a linear flow velocity at the exit of each hole of a typical plate of about 18.2 cm/sec.

In various embodiments, the IRFP plate has a sufficiently low porosity and pore size to provide a viscous backpressure and high vertical impinging flow rates at normal operating volumetric flow rate. In some cases, between about 0.1% and 10% of the IRFP plate is open area allowing fluid to reach the wafer surface. In particular embodiments, between about 1% and 5% the plate is open area. In a specific example, the open area of the plate is about 3.2% and the effective total open cross sectional area is about 23 $cm^2$.

The porosity of the IRFP plate can be implemented in many different ways. In various embodiments, it is implemented with many vertical holes of small diameter. In some cases the plate does not consist of individual "drilled" holes, but is created by a sintered plate of continuously porous material. Examples of such sintered plates are described in U.S. Pat. No. 6,964,792, which is herein incorporated by reference in its entirety for all purposes. In some embodiments, drilled non-communicating holes have a diameter of between about 0.01 to 0.05 inches. In some cases, the holes have a diameter of between about 0.02 to 0.03 inches. As mentioned above, in various embodiments, the holes have a diameter that is at most about 0.2 times the gap distance between the IRFP plate and the wafer. The holes are generally circular in cross section, but need not be. Further, to ease construction, all holes in the plate may have the same diameter. However this need not be the case, and so both the individual size and local density of holes may vary over the plate surface as specific requirements may dictate.

As an example, a solid IRFP plate made of a suitable ceramic or plastic (generally a dielectric insulating and mechanically robust material), having a large number of small holes provided therein, e.g. at least about 1000 or at least about 3000 or at least about 5000 or at least about 6000. The porosity of the plate is typically less than about 5 percent so that the total flow rate necessary to create a high impinging velocity is not too great. Using smaller holes helps to create a large pressure drop across the plate than larger holes, aiding in creating a more uniform upward velocity through the plate.

Generally, the distribution of holes over the IRFP plate is of uniform density and non-random. In some cases, however, the density of holes may vary, particularly in the radial direction. For instance, in order to enhance the capability of an electroplating apparatus to dynamically tune shielding (and the rate of electroplating) in the edge regions of the wafers being electroplated, an IRFP plate may be employed which has a greater porosity in its edge region relative to the rest of its surface. This may be accomplished by the plate having a higher average number of holes per unit area and/or higher average hole diameter in an edge region of the plate relative to the rest of the plate.

In some embodiments, the IRFP plate provides ionic resistance substantial enough to generate a substantially uniform potential and current distribution over the substrate's radius when electroplating onto relatively thin metallized or otherwise highly resistive surfaces. This significant ionic resistance is important, because the cross wafer resistance and resistance from the wafer periphery to its center may remain high throughout the entire process. Having a significant ionic resistance throughout the entire plating process allow a useful means of maintaining a uniform plating process and enables the use of thinner seed layers than would be otherwise possible. This addresses the "terminal effect" as described in U.S. patent application Ser. No. 12/291,356, previously incorporated by reference.

Moreover, it is noted that since, in certain embodiments, the IRFP plate approximates a nearly constant current source in close proximity to the substrate (cathode) being electroplated, the plate may be referred to as a high-resistance virtual anode (HRVA). In contrast, an actual anode in the same close substrate proximity would be significantly less apt to supply a nearly constant current to the substrate, but would merely support a constant potential at the anode metal surface, thereby allowing the current to be greatest where the net resistance from the anode plane to the terminus (e.g., to peripheral contact points on the substrate) is smaller. Thus, because the IRFP plate may be viewed as the surface from which the anodic current is emanating, it may be considered and referred to as a "virtual current source," or more particularly, as a "virtual anode." The relatively high ionic-resistance of the plate (with respect to the electrolyte) is what leads to further advantageous, electroplating uniformity when compared to having a metallic anode located at the same physical location.

The high ionic resistance of the IRFP plate is also affected by the thickness and conductivity of the plate. The low conductivity (or high resistivity) of the plate can be achieved by either selecting a material that has a low ionic conductivity, or by choosing an ionically insulating material and drilling holes through the material to introduce anisotropic ionic conductivity, as described above. In the latter case, examples of ionically resistive materials of which the plate may be constructed include polyethylene, polypropylene, polyvinylidene difluoride (PVDF), polytetrafluoroethylene, polysulphone, and polycarbonate, or combinations thereof. In one embodiment, the plate may be between about 5 and 10 mm thick. The final conductivity of the plate may be between about 1% and 20% of the conductivity of the plating solution media, although plates with conductivities that are lower than about 1% of the conductivity of the plating solution may also be used.

In many embodiments, the pores (e.g. holes) of the IRFP plate are not interconnected, but rather are non-communicating, i.e., they are isolated from each other and do not form interconnecting channels within the body of the plate. Such holes may be referred to as 1-D through-holes because they extend in one dimension, in one example, normal (perpendicular) to the plating surface of the wafer. That is, in some embodiments, the channels are oriented at an angle of about 90° with respect to the substrate-facing surface of the plate. Moreover, because such non-communicating through-holes with directionality normal to the face of the plate (and to the surface of the substrate) do not allow for lateral movement of ionic current or fluid motion within the plate, the center-to-edge current and flow movements are blocked within the plate (in this type of embodiment), leading to further improvement in radial plating uniformity. Thus, in certain embodiments, the plate has predominantly an anisotropic conductance, allowing current flow substantially in the z-direction (i.e., perpendicular to the plate and substrate surfaces), and substantially preventing current flow in the r-direction (the radial direction parallel to the surfaces of the plate and substrate). In actual application, due to the finite size of the holes drilled through the plate, there will be some r-directed current flow inside the holes, but this level of current is negligible as compared to the ionic current that flows in the z-direction.

In other embodiments, the through-holes of the IRFP plate may be oriented at angles which are non-normal (not perpendicular) to the face of the plate. In some embodiments, the holes may be about 20° to about 60° with respect to the substrate-facing surface of the plate, or in another embodiment, about 30° to about 50° with respect to the substrate-facing surface of the plate. In some embodiments, the plate includes through-holes oriented at different angles. The hole pattern on the plate can include uniform, non-uniform, symmetric and asymmetric elements, i.e. the density and pattern of holes may vary across the plate. In certain embodiments, the channels are arranged to avoid long range linear paths parallel to the substrate-facing surface that do not encounter one of the channels. In one embodiment, the channels are arranged to avoid long range linear paths of about 10 mm or greater that are parallel to the substrate-facing surface that do not encounter one of the channels.

Electroplating Systems

Figure 8:
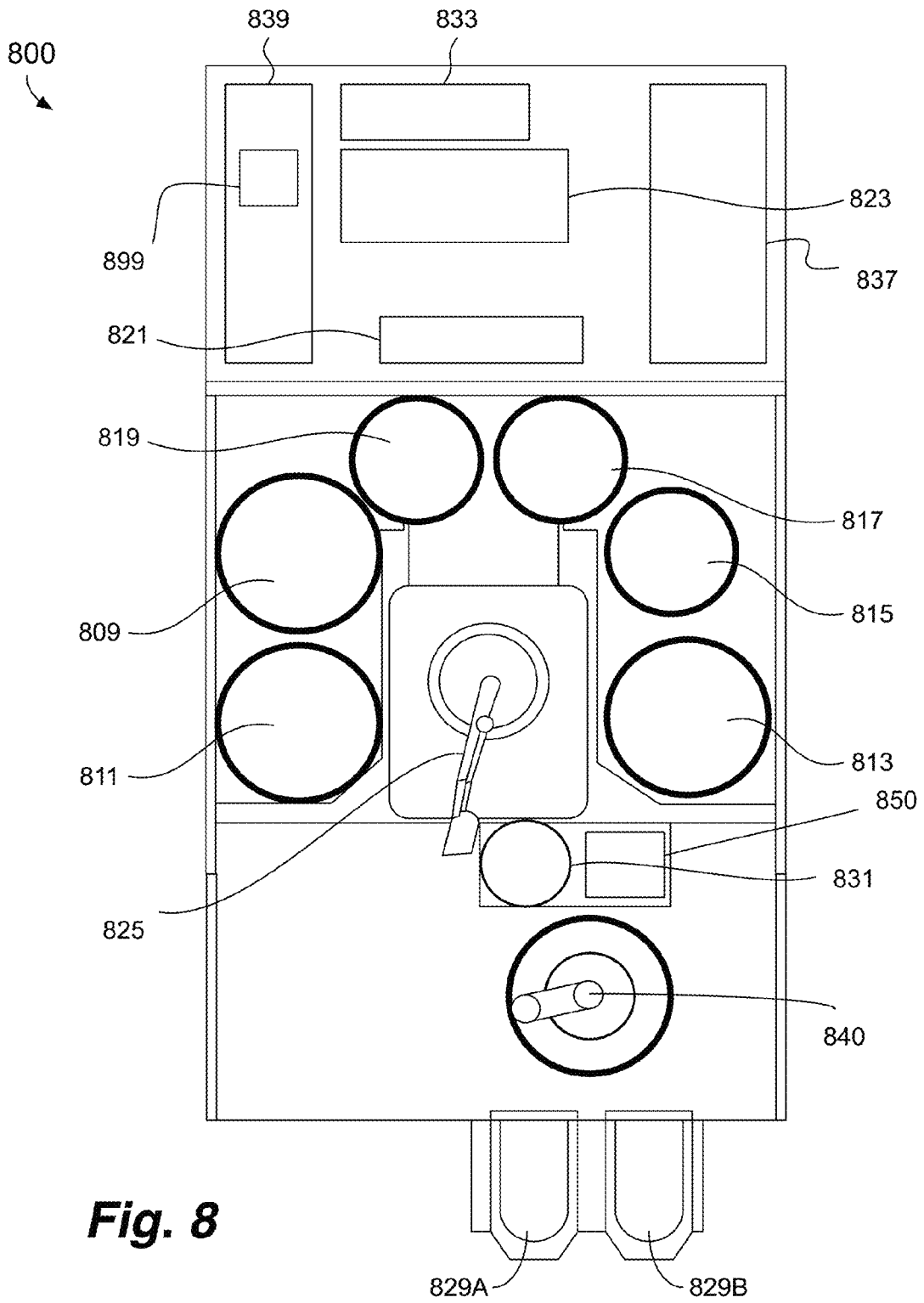
FIG. 8 schematically illustrates an electroplating system which includes multiple electroplating modules, each of which could be an electroplating apparatus similar to that schematically illustrated in FIG. 1.

The electroplating apparatus of FIG. 1 may be employed as an electroplating module of a larger electroplating system, such as the electroplating system schematically illustrated in FIG. 8. In particular, FIG. 8 illustrates an electroplating system 800 which includes three separate electroplating modules 809, 811, and 813, any one of which may be as described above with respect to FIG. 1.

The electroplating system 800 shown in FIG. 8 further includes three separate post-electrofill modules (PEMs) 815, 817 and 819. Depending on the embodiment, each of these may be employed to perform any of the following functions: edge bevel removal (EBR), backside etching, and acid cleaning of wafers after they have been electrofilled by one of modules 809, 811, and 813. Note that a post-electrofill module (PEM) which performs edge bevel removal (EBR) will alternatively be referred to herein simply as an EBR module. Electroplating system 800 may also include a chemical dilution module 821 and a central electrofill bath 823. The latter may be a tank that holds the chemical solution used as the electroplating bath in the electrofill modules. Electroplating system 800 may also include a dosing system 833 that stores and delivers chemical additives for the plating bath. If present, the chemical dilution module 821 may store and mix chemicals to be used as the etchant in the post electrofill modules. In some embodiments, a filtration and pumping unit 837 filters the plating solution for central bath 823 and pumps it to the electrofill modules.

Finally, in some embodiments, an electronics unit 839 may serve as a system controller providing the electronic and interface controls required to operate electroplating system 800. The system controller typically includes one or more memory devices and one or more processors configured to execute instructions so that the electroplating system can perform its intended process operations. Machine-readable media containing instructions for controlling process operations in accordance with the implementations described herein may be coupled to the system controller. Unit 839 may also provide a power supply 899 for the system.

In operation, a robotic wafer transfer mechanism may be used for transferring wafers to and from one or more wafer storage devices, one or more electroplating modules, and one or more seed layer analysis systems (although, it is noted that in some embodiments, a seed layer analysis system may analyze wafers while held in the wafer holder of an electroplating module). For example, referring again to FIG. 8, a robot including a back-end robot arm 825 may be used to select wafers from a wafer cassette, such as a cassette 829A or 829B, which serve as wafer storage devices for storing, loading, and unloading wafers. Back-end robot arm 825 may attach to the wafer using a vacuum attachment or some other feasible attaching mechanism.

A front-end robot arm 840 may select a wafer from a wafer cassette such as the cassette 829A or the cassette 829B. The cassettes 829A or 829B may be front opening unified pods (FOUPs). A FOUP is an enclosure designed to hold wafers securely and safely in a controlled environment and to allow the wafers to be removed for processing or measurement by tools equipped with appropriate load ports and robotic handling systems. The front-end robot arm 840 may hold the wafer using a vacuum attachment or some other attaching mechanism. The front-end robot arm 840 may interface with the cassettes 829A or 829B, a transfer station 850, or an aligner 831. From the transfer station 850, back-end robot arm 825 may gain access to the wafer. The transfer station 850 may be a slot or a position to and from which front-end robot arm 840 and back-end robot arm 825 may pass wafers without going through the aligner 831. In some implementations, however, to ensure that a wafer is properly aligned on the back-end-robot 825 for precision delivery to an electroplating module, the back-end robot arm 825 may align the wafer with aligner 831. Back-end robot arm 825 may also deliver a wafer to one of the electrofill modules 809, 811, or 813 or to one of the three post-electrofill modules 815, 817, and 819.

In situations where the aligner module 831 is to be used to ensure that the wafer is properly aligned on back-end robot arm 825 for precision delivery to an either an electroplating module 809, 811, or 813, or an EBR module 815, 817, and 819 (assuming these PEMs perform EBR), back-end robot arm 825 transports the wafer to aligner module 831. In certain embodiments, aligner module 831 includes alignment arms against which back-end robot arm 825 pushes the wafer. When the wafer is properly aligned against the alignment arms, the back-end robot arm 825 moves to a preset position with respect to the alignment arms. In other embodiments, the aligner module 831 determines the wafer center so that the back-end robot arm 825 picks up the wafer from the new position. It then reattaches to the wafer and delivers it to one of the electroplating modules 809, 811, or 813, or EBR modules 815, 817, and 819.

Thus, in a typical operation of forming a layer of metal on a wafer using the electroplating system 800, back-end robot arm 825 transports a wafer from wafer cassette 829A or 829B to aligner module 831 for pre-electroplating centering adjustment, then to electroplating module 809, 811, or 813 for electroplating, then back to aligner module 831 for pre-EBR centering adjustment, and then to EBR module 815, 817, or 819 for edge bevel removal. Of course, in some embodiments, a centering/alignment step may be omitted if realignment of the wafer is typically not necessary.

As described more fully below, the electroplating operation may involve loading the wafer in a clamshell type wafer holder and lowering the clamshell into an electroplating bath contained within a cell of one of electroplating modules 809, 811, or 813 where the electroplating is to take place. The cell oftentimes contains an anode which serves as a source of the metal to be plated (although the anode may be remote), as well as an electroplating bath solution oftentimes supplied by the central electrofill bath reservoir 823 along with optional chemical additives from a dosing system 833. The EBR operation subsequent to the electroplating operation typically involves removing unwanted electroplated metal from the edge bevel region and possibly the backside of the wafer by way of applying an etchant solution which is provided by chemical dilution module 821. After EBR, the wafer is typically cleaned, rinsed, and dried.

Finally, it is noted that after post-electrofill processing is complete, back-end robot arm 825 may retrieve the wafer from the EBR module and returns it to cassette 829A or 829B. From there the cassettes 829A or 829B may be provided to other semiconductor wafer processing systems such as a chemical mechanical polishing system, for example.

System Controllers

In some implementations, a controller is part of a system, which may be part of the above-described examples. Such systems can comprise semiconductor processing equipment, including a processing tool or tools, chamber or chambers, a platform or platforms for processing, and/or specific processing components (a wafer pedestal, a gas flow system, etc.). These systems may be integrated with electronics for controlling their operation before, during, and after processing of a semiconductor wafer or substrate. The electronics may be referred to as the "controller," which may control various components or subparts of the system or systems. The controller, depending on the processing requirements and/or the type of system, may be programmed to control any of the processes, methods, and/or operations disclosed herein, including the delivery of processing gases, temperature settings (e.g., heating and/or cooling), pressure settings, vacuum settings, power settings, radio frequency (RF) generator settings, RF matching circuit settings, frequency settings, flow rate settings, fluid delivery settings, positional and operation settings, wafer transfers into and out of a tool and other transfer tools and/or load locks connected to or interfaced with a specific system.

Broadly speaking, the controller may be defined as electronics having various integrated circuits, logic, memory, and/or software that receive instructions, issue instructions, control operation, enable cleaning operations, enable endpoint measurements, and the like. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a particular process on or for a semiconductor wafer or to a system. The operational parameters may, in some embodiments, be part of a recipe defined by process engineers to accomplish one or more processing steps during the fabrication of one or more layers, materials, metals, oxides, silicon, silicon dioxide, surfaces, circuits, and/or dies of a wafer.

The controller, in some implementations, may be a part of or coupled to a computer that is integrated with, coupled to the system, otherwise networked to the system, or a combination thereof. For example, the controller may be in the "cloud" or all or a part of a fab host computer system, which can allow for remote access of the wafer processing. The computer may enable remote access to the system to monitor current progress of fabrication operations, examine a history of past fabrication operations, examine trends or performance metrics from a plurality of fabrication operations, to change parameters of current processing, to set processing steps to follow a current processing, or to start a new process. In some examples, a remote computer (e.g. a server) can provide process recipes to a system over a network, which may include a local network or the Internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations. It should be understood that the parameters may be specific to the type of process to be performed and the type of tool that the controller is configured to interface with or control. Thus as described above, the controller may be distributed, such as by comprising one or more discrete controllers that are networked together and working towards a common purpose, such as the processes and controls described herein. An example of a distributed controller for such purposes would be one or more integrated circuits on a chamber in communication with one or more integrated circuits located remotely (such as at the platform level or as part of a remote computer) that combine to control a process on the chamber.

Without limitation, example systems may include a plasma etch chamber or module, a deposition chamber or module, a spin-rinse chamber or module, a metal plating chamber or module, a clean chamber or module, a bevel edge etch chamber or module, a physical vapor deposition (PVD) chamber or module, a chemical vapor deposition (CVD) chamber or module, an atomic layer deposition (ALD) chamber or module, an atomic layer etch (ALE) chamber or module, an ion implantation chamber or module, a track chamber or module, and any other semiconductor processing system that may be associated with or used in the fabrication and/or manufacturing of semiconductor wafers.

As noted above, depending on the process step or steps to be performed by the tool, the controller might communicate with one or more of other tool circuits or modules, other tool components, cluster tools, other tool interfaces, adjacent tools, neighboring tools, tools located throughout a factory, a main computer, another controller, or tools used in material transport that bring containers of wafers to and from tool locations and/or load ports in a semiconductor manufacturing factory.

Other Embodiments

Although the foregoing disclosed techniques, operations, processes, methods, systems, apparatuses, tools, films, chemistries, and compositions have been described in detail within the context of specific embodiments for the purpose of promoting clarity and understanding, it will be apparent to one of ordinary skill in the art that there are many alternative ways of implementing the foregoing embodiments which are within the spirit and scope of this disclosure. Accordingly, the embodiments described herein are to be viewed as illustrative of the disclosed inventive concepts rather than restrictively, and are not to be used as an impermissible basis for unduly limiting the scope of any claims eventually directed to the subject matter of this disclosure.

We claim:

1. A method of electroplating one or more semiconductor substrates in an apparatus, wherein the apparatus comprises:

an electroplating cell;

a substrate holder configured to hold a substrate within the electroplating cell;

a fluidically-permeable plate located within the electroplating cell and oriented substantially parallel to the substrate held in the substrate holder, wherein the plate has multiple pores which, when immersed in electroplating solution, provide a fluidic connection between said electroplating solution on opposite sides of the plate;

a plurality of seals, wherein each seal is configured, when in its sealing configuration, to substantially seal a subset of the pores of the fluidically-permeable plate, the subset located in an edge region of the plate, wherein one or more seals of the plurality of seals are configured to be individually activated from a non-sealing configuration to the sealing configuration;

a power supply configured to apply an electrical potential between an anode in the electroplating cell and the substrate held by the substrate holder sufficient to cause electroplating on the substrate; and a controller comprising a processor and a memory, the controller configured to set the configuration of the one or more seals of the plurality of seals;

wherein, during application of said electrical potential, the rate of electroplating in an edge region of the substrate is affected by the configuration of the one or more seals of the plurality of seals, wherein the method comprises:

(a) setting the configuration of the one or more seals of the plurality of seals which, when in their sealing configuration, substantially seal the subset of the pores of the fluidically-permeable plate, the subset located in the edge region of the fluidically-permeable plate; and (b) applying an electrical potential between the anode and the first substrate sufficient to cause electroplating on the first substrate, wherein the rate of electroplating in an edge region of the first substrate is affected by the configuration of the one or more seals.

2. The method of claim 1, wherein the one or more seals of the plurality of seals, when in their sealing configuration, seal the subset of pores in the edge region of the fluidically-permeable plate by contacting the fluidically-permeable plate in the edge region.

3. The method of claim 2, wherein the plurality of seals comprise two inflatable seals which, when in their sealing configuration, are inflated so as to contact the fluidically-permeable plate in the edge region, and wherein setting the configuration of the one or more seals comprises inflating and/or deflating the one or more of the seals.

4. The method of claim 1, wherein the edge region of the first substrate is from the first substrate's edge to about 0.5 inches of its edge, and the edge region of the fluidically-permeable plate is from the plate's edge to about 2 inches of its edge.

5. The method of claim 4, wherein the edge region of the fluidically-permeable plate has a greater average porosity than the average porosity over the other portions of the fluidically-permeable plate.

6. The method of claim 1, further comprising:

adjusting the configuration of the one or more seals of the plurality of seals multiple times during the electroplating of the first substrate to vary the rate of electroplating in the edge region of the first substrate multiple times while electroplating the first substrate.

7. The method of claim 1, further comprising:

(c) replacing the first substrate in the electroplating cell with a second substrate having a diameter significantly different than the diameter of the first substrate;

(d) adjusting the configuration of the one or more seals of the plurality of seals for the second substrate;

(e) applying an electrical potential between the anode and the second substrate sufficient to cause electroplating on the second substrate, wherein the rate of electroplating in an edge region of the second substrate is affected by the adjusted configuration of the one or more seals.

8. The method of claim 1, wherein the anode comprises copper and the electroplating results in the deposition of copper on the first substrate.

9. An apparatus for electroplating one or more semiconductor substrates, the apparatus comprising:

an electroplating cell;

a substrate holder configured to hold a substrate within the electroplating cell;

a fluidically-permeable plate located within the electroplating cell and oriented substantially parallel to the substrate held in the substrate holder, wherein the fluidically-permeable plate has multiple pores which, when immersed in electroplating solution, provide a fluidic connection between said electroplating solution on opposite sides of the plate;

a plurality of seals, wherein each seal is configured, when in its sealing configuration, to substantially seal a subset of the pores of the fluidically-permeable plate, the subset located in an edge region of the plate, wherein one or more seals of the plurality of seals are configured to be individually activated from a non-sealing configuration to the sealing configuration;

a power supply configured to apply an electrical potential between an anode in the electroplating cell and the substrate held by the substrate holder sufficient to cause electroplating on the substrate; and a controller comprising a processor and a memory, the controller configured to set the configuration of the one or more seals of the plurality of seals;

wherein, during application of said electrical potential, the rate of electroplating in an edge region of the substrate is affected by the configuration of the one or more seals of the plurality of seals.

10. The apparatus of claim 9, wherein the one or more seals of the plurality of seals, when in their sealing configuration, seal the subset of pores in the edge region by contacting the fluidically-permeable plate in the edge region.

11. The apparatus of claim 10, wherein the plurality of seals comprise two inflatable seals which, when in their sealing configuration, are inflated so as to contact the fluidically-permeable plate in the edge region.

12. The apparatus of claim 11, wherein the two inflatable seals are substantially ring-shaped and oriented such that their center axes substantially align with the center axis of a substrate placed in the electroplating cell.

13. The apparatus of claim 12, wherein the two inflatable ring-shaped seals each have a contact side configured to contact the fluidically-permeable plate when the seals are inflated in their sealing configuration, and wherein each of said contact sides has a radial width of between about 0.1 and 1 inch.

14. The apparatus of claim 13, wherein each of said contact sides has a radial width of between about 0.2 and 0.4 inches.

15. The apparatus of claim 9, wherein the edge region of the substrate is from the substrate's edge to about 0.5 inches of its edge, and the edge region of the fluidically-permeable plate is from the plate's edge to about 2 inches of its edge.

16. The apparatus of claim 15, wherein the edge region of the fluidically-permeable plate has a greater average porosity than the average porosity over the other portions of the fluidically permeable plate.

17. The apparatus of claim 16, wherein the edge region of the fluidically permeable plate has a greater average pore number density per unit area than the average over the other portions of the fluidically permeable plate.

18. The apparatus of claim 16, wherein the edge region of the fluidically permeable plate has a greater average pore size than the average over the other portions of the fluidically permeable plate.

19. The apparatus of claim 16, wherein the average porosity in the edge region of the fluidically permeable plate is at least 1.5 times the average porosity over the other portions of the fluidically permeable plate.

20. The apparatus of claim 9, wherein the controller is configured to execute machine-readable instructions comprising:

instructions for adjusting the configuration of the one or more seals multiple times during the electroplating of the substrate to vary the electroplating rate in the edge region of the substrate multiple times while electroplating the substrate.

* * * * *